US009959848B2

(12) United States Patent
Yonezu

(10) Patent No.: US 9,959,848 B2
(45) Date of Patent: May 1, 2018

(54) MUTE EQUIPMENT CAPABLE OF CONTROLLING A BREATH PRESSURE AND AN ADAPTER THEROF

(71) Applicant: Office Itsuki Agency Co., Ltd., Yamato-shi (JP)

(72) Inventor: Mitsuo Yonezu, Yokohama (JP)

(73) Assignee: Office Itsuki Agency Co., Ltd., Kanagawa (JP)

( * ) Notice: Subject to any disclaimer, the term of this patent is extended or adjusted under 35 U.S.C. 154(b) by 0 days. days.

(21) Appl. No.: 15/549,950

(22) PCT Filed: Dec. 16, 2015

(86) PCT No.: PCT/JP2015/085289
§ 371 (c)(1),
(2) Date: Aug. 9, 2017

(87) PCT Pub. No.: WO2016/129176
PCT Pub. Date: Aug. 18, 2016

(65) Prior Publication Data

US 2018/0033415 A1 Feb. 1, 2018

(30) Foreign Application Priority Data

Feb. 10, 2015 (WO) ..... PCT/JP2015/053697

(51) Int. Cl.
*G10D 9/06* (2006.01)
*G10D 7/04* (2006.01)
*G10D 9/02* (2006.01)

(52) U.S. Cl.
CPC ..... *G10D 9/06* (2013.01); *G10D 7/04* (2013.01); *G10D 9/02* (2013.01)

(58) Field of Classification Search
CPC ..... G10D 9/06; G10D 9/02; G10D 7/04
See application file for complete search history.

(56) References Cited

U.S. PATENT DOCUMENTS 1,737,098 A * 11/1929 Schumann ..... G10D 7/10 84/400
2,247,441 A * 7/1941 Hulsaver ..... G10D 9/02 84/383 R (Continued)

FOREIGN PATENT DOCUMENTS

JP H11-030981 2/1999
JP 2010085960 4/2010

(Continued)

OTHER PUBLICATIONS

Office Action received in corresponding application pending before the Korean Patent Office; dated Aug. 8, 2017.

(Continued)

*Primary Examiner* — Robert W Horn
(74) *Attorney, Agent, or Firm* — ALG Intellectual Property, LLC

(57) ABSTRACT

A mute equipment capable of controlling a breath pressure and reducing the volume of the sound during a performance state in normal manner, an adapter thereof and the wind instruments equipped with them, are characterized in that it the mute equipment capable of controlling a breath pressure is to be attached to the blowing section of the wind instruments, wherein the equipment has a hole to release the breath and a section of restricting a wind way width. The mute equipment capable of controlling a breath pressure may be further characterized in that the equipment has a section of adjusting a breath volume to adjust the size of the hole to release the breath. The mute equipment capable of controlling a breath pressure may be further characterized in that the section of adjusting a breath volume can use as the section of restricting the wind way width.

15 Claims, 6 Drawing Sheets

(56) References Cited

U.S. PATENT DOCUMENTS

| | | | | | |
|---|---|---|---|---|---|
| 2,263,665 | A * | 11/1941 | White | G10D 9/06 | 84/400 |
| 3,224,315 | A * | 12/1965 | Guinness | G10D 7/023 | 84/380 C |
| 4,178,830 | A | 12/1979 | Ramirez | | |
| 2010/0031801 | A1 * | 2/2010 | Montemurro | G10D 7/023 | 84/400 |

FOREIGN PATENT DOCUMENTS

| | | |
|---|---|---|
| JP | 2013137481 | 7/2013 |
| JP | 2014-029383 | 2/2014 |
| JP | 2014228859 | 12/2014 |

OTHER PUBLICATIONS

Is Ocarina a Closed Pipe; http://www.ne.jp/asahi/suimin/japan/heikan_e.htm; 2001.
Search Report and Written Opinion received in international Application No. PCT/JP201/085289; dated Feb. 9, 2016.

* cited by examiner

[Figure 1]
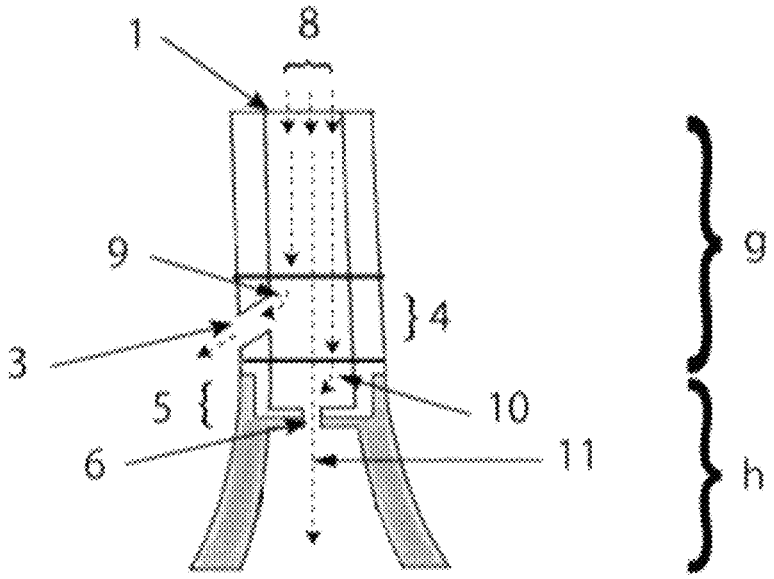

[Figure 2]
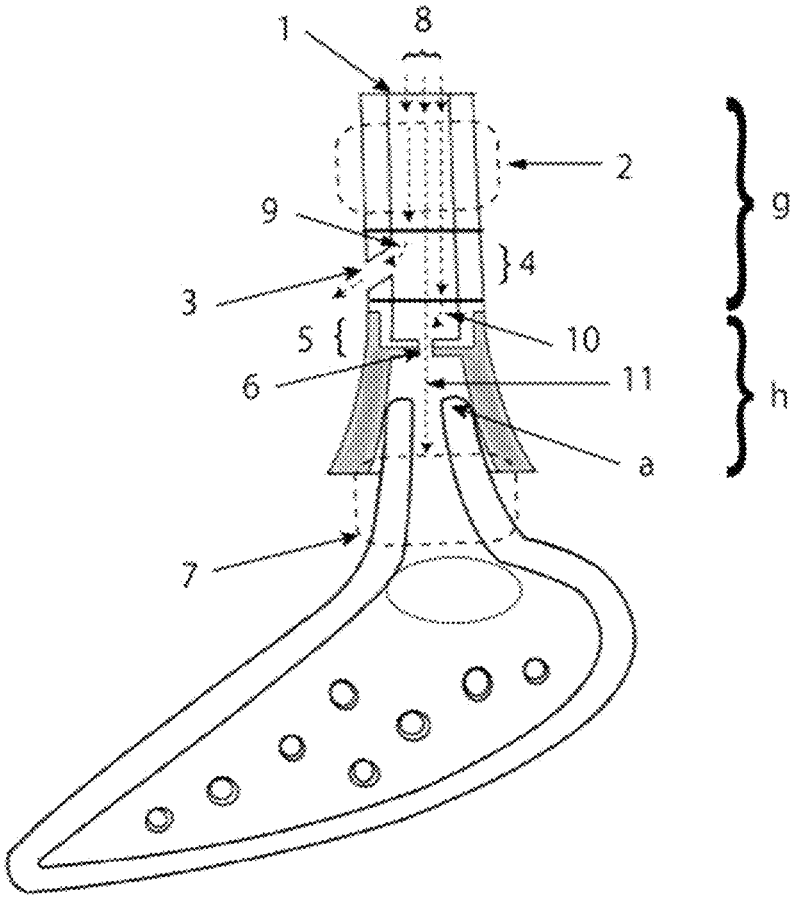

[Figure 3]
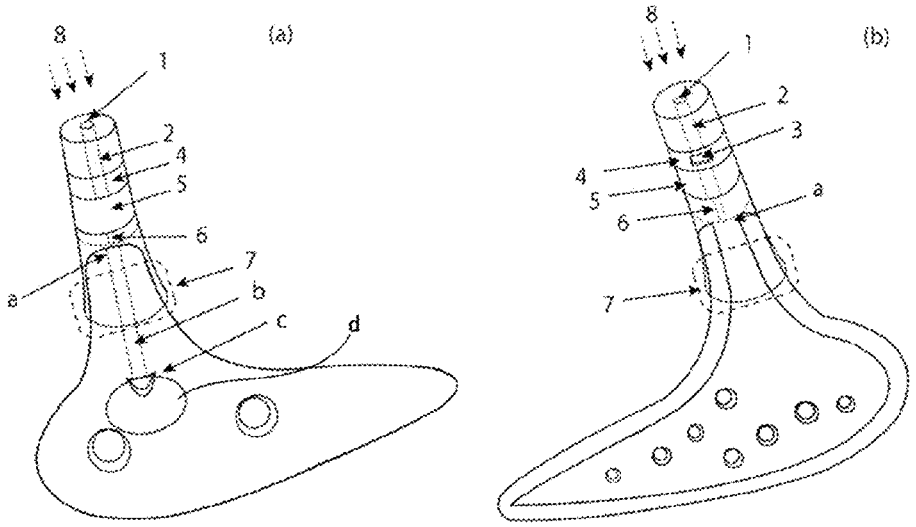
[Figure 4]
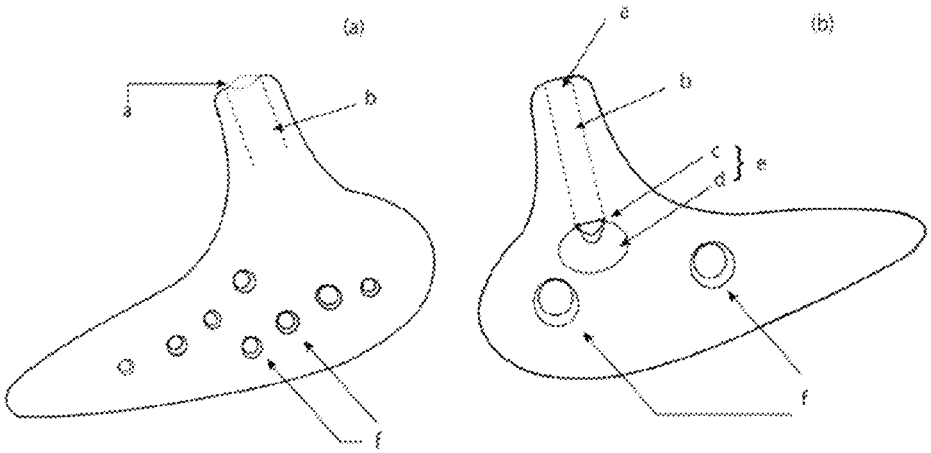

[Figure 5]
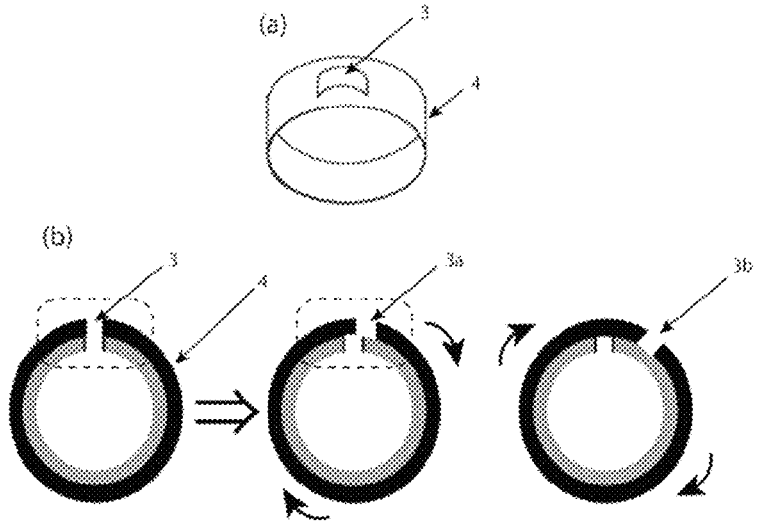
[Figure 6]
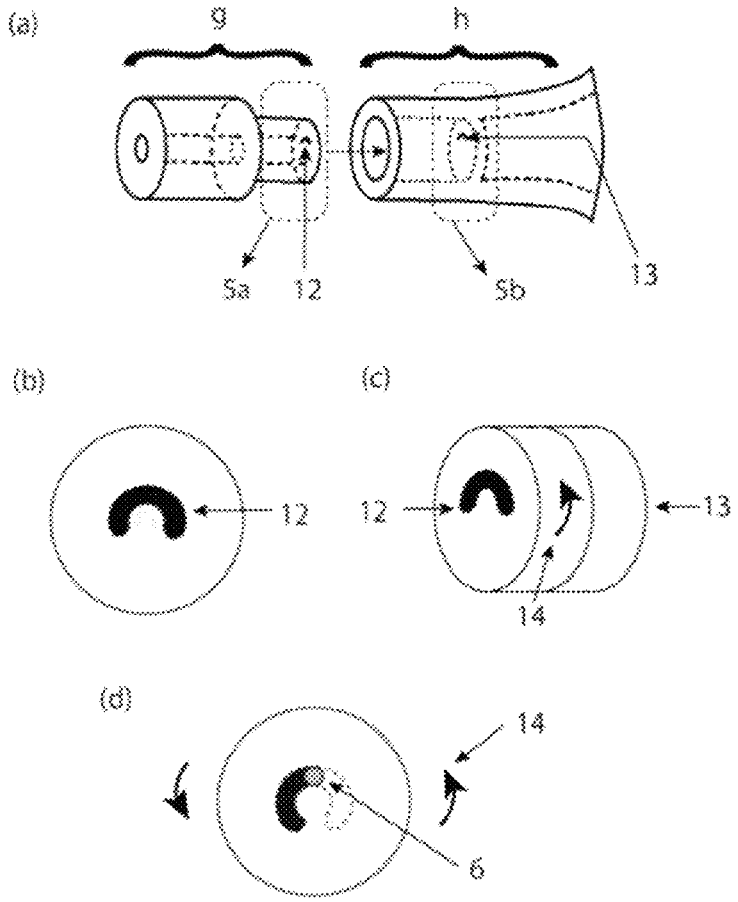

[Figure 7]
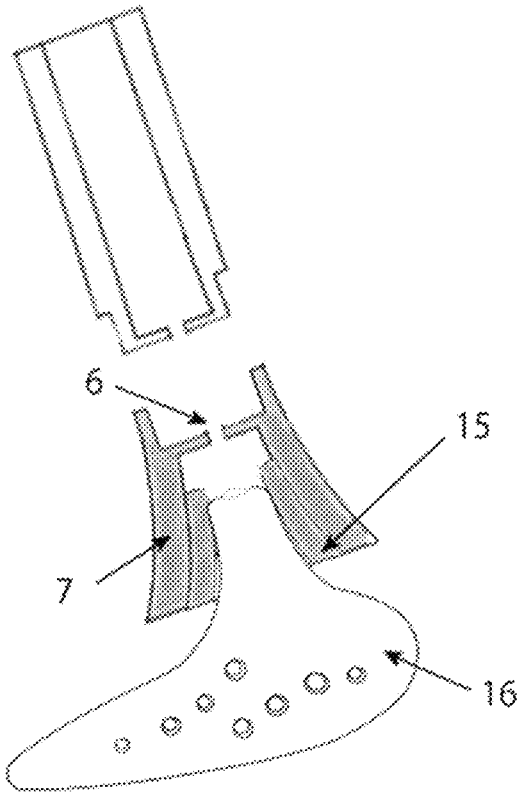

[Figure 8]
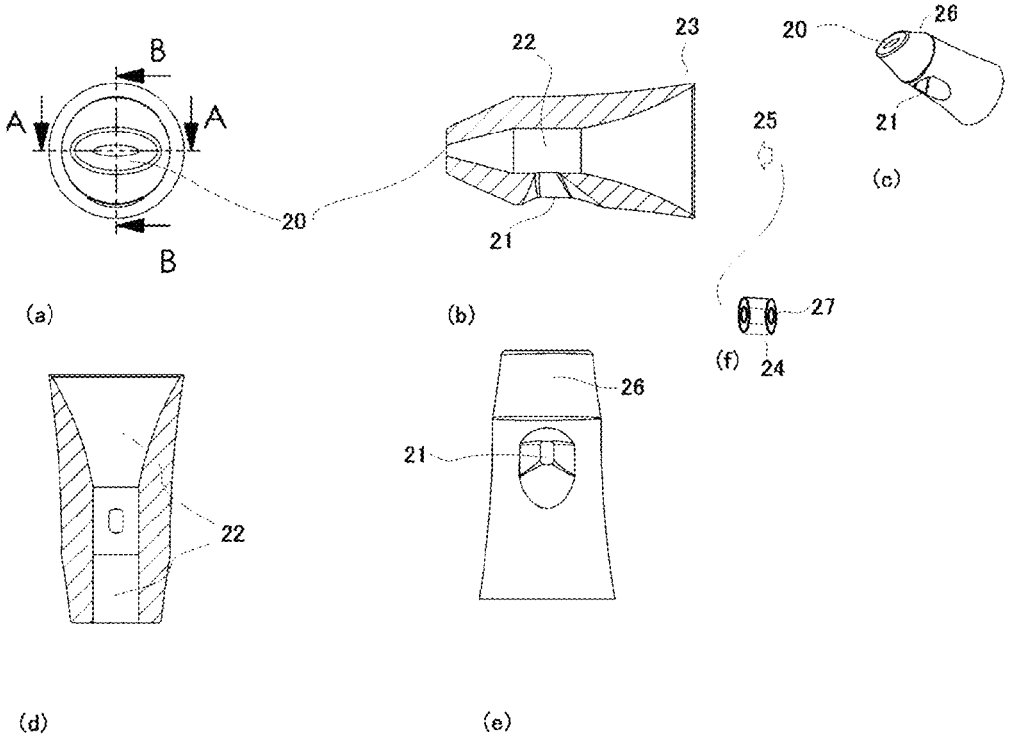

MUTE EQUIPMENT CAPABLE OF CONTROLLING A BREATH PRESSURE AND AN ADAPTER THEROF

TECHNICAL FIELD

The present invention relates to a mute equipment capable of controlling a breath pressure, an adapter thereof and wind instruments equipped with them, and more particularly, to a mute equipment capable of controlling a breath pressure designed to permit to effectively mute sound generated by wind instruments, an adaptor thereof and wind instruments equipped with them.

BACKGROUND ART

Up to now, woodwind instruments can generate sound by vibrating a reed installed therein, or by vibration created by airflow blown into them so that it is possible to mute or absorb the sound by controlling amplitude of such vibrations.

Among others, a recorder, one of the woodwind instruments, has an air reed comprising a window section and a wind way, and enables to generate sound by vibration created by airflow blown into it. It has been known that it is possible to mute the sound by applying a certain material to or installing an equipment at the window section, the wind way and the edge section of the recorder (Patent Literature 1).

For example, according to the Prior Art described in the Patent Literature 1, an equipment capable of generating sound without affecting the quality of the sound and adjusting the volume of sound is proposed. This equipment is to be used for the wind instruments having an air reed including recorders and able to be attached to the wind way, the window section and the edge section of such wind instruments. Particularly, the Patent Literature 1 explains that, unlike in the case of recorders, an ocarina, another wind instrument, is not cylindrical shaped and so that a belt and rubber bands for fixing are used exclusively for the ocarina in order to mute the sound by lowering the sound pressure through sliding a section capable of blocking the exhaled breath.

Further, as for brass wind instruments, an equipment attached inside of its bell has been known as equipment to mute the sound (the Patent Literature 2). According to the Prior Art described in the Patent Literature 2, as a muter to be used for woodwind instruments including recorders, an equipment to absorb sound is proposed wherein a three dimensional, net-like porous and cylindrical shaped equipment is installed inside a pipe of the body of the instrument.

PRIOR ART LITERATURE

Patent Literature

Patent literature 1: JP-A-2013-137481

Patent literature 2: JP-A-2010-85960

Non-Patent Literature

Non-Patent Literature 1: "Ocarina is a closed-end wind instrument?" referred to in the website "Ocarina no Komichi".

DISCLOSURE OF THE INVENTION

Problems to be Resolved by the Invention

As mentioned above, a variety of equipment to mute sound has been already developed for both the brass wind instruments and the woodwind instruments, and a similarly-structured equipment to mute or absorb sound or an equipment to adjust sound pressure has been developed for recorders and certain woodwind instruments with air reed equipped with the windway, the window section and the edge section. No equipment, however, has been developed yet to directly adjust the volume of the breath to be blown into wind instruments in order to mute sound.

Furthermore, when we practice one of the wind instruments, although it is desirable to do it in a music studio or in a place where a sound proof is applied, but in reality, it is common to do it at home. Especially for ocarinas, most of its enthusiasts are house wives or elder persons and it is quite likely that they practice the ocarinas at home.

Furthermore, given the recent housing conditions, there are some problems that because of the night time or in a neighboring environment (existence of infants and young children, or restriction for playing music instruments because it is annoying to multiple families living in housing complexes, etc.), some sounds generated by exercise of the wind instrument are noisy, and it is impossible or often restricted for them to practice the instrument.

Under these circumstances, it is desired to reduce the sound of the wind instrument as much as possible.

However, in the above Patent Literatures 1 and 2, in the case that the equipment to mute sound for the wind instrument of the prior art such as a wind instrument with reed is attached to such a wind instrument which should be muted, there are some problems that it may be impossible in some cases to generate sound properly unless a player of such a wind instrument reduces the volume of breath gradually as the player generates the sound shifting from bass register to treble part. More specifically although there are some type of the wind instruments having a property wherein it is impossible to generate sound properly, an optimum equipment to mute sound to be attached to such wind instruments does not exist yet so far.

At this moment, according to the paragraph [0019] in the above-mentioned Patent Literature 1, it is mentioned that when the conventional equipment to mute sound for the wind instrument with reed is attached to the recorder, the pitch of sound becomes lower than it should be, but it is possible to adjust the pitch on the recorder by adjusting the distance of the joint line between the pipe of the head (upper) part of the recorder and the pipe of the middle part thereof. However, in the wind instruments including ocarinas which do not have such a structure, since the practice by using sound source for accompaniment or the practice by combining the accompaniment instrument under the circumstances that the conventional equipment to mute sound for wind instrument with an air reed is just attached to, makes it possible not to match the pitch of sound on these wind instruments with those of on the sound source for accompaniment, and therefore it is not practical to apply the conventional equipment to mute sound for wind instrument with an air reed to the wind instruments in general in terms of the pitch accuracy in performing music on the wind instruments.

Next, as for the wind instruments such as ocarinas, large-scaled manufacturers make them in large quantity with the same quality and in the same shape by using a mold while individual designers make them one by one by hand so that the number of manufacturers of the wind instruments including ocarinas is countless, and therefore the outer appearance, shape, size, material to be used, surface coating as well as the shape and the size of a blowing section, the shape, the thickness and the length of the wind way, the shape and the depth of the window section, the shape of the edge section, etc. of the ocarinas are of great variety. Taking this into consideration, it is unrealistic to decide that the conventional equipment to mute sound for the wind instrument with an air reed in a form that it is attached to the voicing section in a conventional manner can be applied to the all wind instruments with an air reed.

In order to apply the conventional equipment to mute sound to the wind instruments with a voicing section, it is physically possible, for example, to apply an adhesive tape or s gel-like material thereof around the voicing section (the window section and the edge section are collectively referred to as the voicing section) of the conventional equipment to mute sound for the wind instruments with an air reed etc.

In this case, there are a wide variety of a method of coating the wind instruments, including a coating made by plastic and metal etc., as well as a coating made by biscuit fire, ceramic and lacquer-coated. There is also a coating by an original drawing on the surface thereof.

Taking these factors into consideration, there are some problems that a higher possibility of damage generates, for example, a coating around the voicing section comes off, and the edge section is cracked, etc.

Although the wind instruments including ocarinas etc., are also classified as the same type of music instrument with the air reed, as same as the above-mentioned recorders, as mentioned above especially the ocarinas have basically "pot-like" structure, different from the structure of the recorders.

Further, in cooperation with the other factors as mentioned below, it is difficult to obtain the originally desired effects sufficiently in the case that the conventional equipment to mute sound is used as it is for the ocarinas.

Therefore, in order to obtain the originally desired effect of muting sound, an equipment is desired that it should be made based on the structural differences observed in each wind instrument with air reed as well as the common factors observed among the wind instruments so as to use it in versatile manner.

It is therefore an object of the present invention to provide a mute equipment capable of controlling a breath pressure and making it possible to reduce the volume of the sound during a performance state in normal manner, an adapter thereof and the wind instruments equipped with them.

Means of Solving the Problems

To achieve the object as mentioned above, the inventor focused attention to the mute equipment capable of controlling a breath pressure. As a result, the inventors discovered the present invention.

That is, the mute equipment capable of controlling a breath pressure according to the present invention is characterized in that it is a mute equipment capable of controlling a breath pressure to be attached to the blowing section of the wind instruments, wherein the equipment has a hole to release the breath and a section of restricting a wind way width.

Furthermore, in a preferred embodiment of the mute equipment capable of controlling a breath pressure according to the present invention, it is characterized in that the equipment further has a section of adjusting a breath volume to adjust the size of the hole to release the breath.

Furthermore, in a preferred embodiment of the mute equipment capable of controlling a breath pressure according to the present invention, it is characterized in that the section of adjusting a breath volume can use as the section of restricting the wind way width.

Furthermore, in a preferred embodiment of the mute equipment capable of controlling a breath pressure according to the present invention, it is characterized in that the section of adjusting a breath volume can adjust the breath volume by using a ring of adjusting the breath volume.

Furthermore, in a preferred embodiment of the mute equipment capable of controlling a breath pressure according to the present invention, it is characterized in that the section of restricting the wind way width has the first hole to adjust the breath volume.

Furthermore, in a preferred embodiment of the mute equipment capable of controlling a breath pressure according to the present invention, it is characterized in that the section of restricting the wind way width is replaceable.

Furthermore, in a preferred embodiment of the mute equipment capable of controlling a breath pressure according to the present invention, it is characterized in that a shape of a cross section of the first hole to adjust the breath volume is a circular arc pattern or a semicircular shape.

Furthermore, in a preferred embodiment of the mute equipment capable of controlling a breath pressure according to the present invention, it is characterized in that the blowing section of the wind instruments is multiple, and the mute equipment capable of controlling a breath pressure can be applied to these multiple blowing sections.

Furthermore, an adapter according to the present invention is characterized in that the adapter can be installed between the mute equipment capable of controlling a breath pressure according to the present invention and a body of the wind instrument, wherein the adapter is capable of attaching to and detaching from the mute equipment capable of controlling a breath pressure and the body of the wind instrument.

Furthermore, in a preferred embodiment of the adapter according to the present invention, it is characterized in that the adapter further has a function of the section of restricting the wind way width at the side of the adapter.

Furthermore, in a preferred embodiment of the adapter according to the present invention, it is characterized in that the adapter further has the second hole to adjust the breath volume.

Furthermore, in a preferred embodiment of the adapter according to the present invention, it is characterized in that a shape of the cross section of the second hole to adjust the breath volume is a circular arc pattern or a semicircular shape.

Furthermore, in a preferred embodiment of the adapter according to the present invention, it is characterized in that the adapter further has an auxiliary adapter.

Furthermore, a wind instrument according to the present invention is characterized by having the mute equipment capable of controlling a breath pressure according to the present invention and/or the adapter according to the present invention.

Further, in the other preferred embodiment of the present invention, a mouthpiece is attached to a blowing section (which is a section to put a breath) of the wind instrument such as an ocarina to breathe into the mouthpiece as substitute for the blowing section of the instrument to discharge a part of a breath passing through an inside of the mouthpiece from "a hole to release the breath" to the outside before a breath arrives at the instrument to narrow the wind way width of the inside of the mouthpiece to further restrict the breath volume arriving at the instrument. By doing this, it is possible to keep a standard performance to reduce a breath volume arriving at the body of the ocarina intentionally and thereby obtaining an effect of a mute finally.

In consideration of the differences of the amount of the breath of a musical performer depending on the performer and a multiplicity of the instrument, it is also possible to flexibly control the breath volume to be discharged and a width of the pathway of the breath inside of the mouthpiece by designing the section of restricting the wind way width or a ring of adjusting the breath volume to the mouthpiece according to need and thereby moving these sections or the ring.

That is, it is characterized in that it is a mute equipment capable of controlling a breath pressure (mouthpiece) attached to the blowing section of the wind instruments to discharge a part of a breath passing through the mouthpiece from "a hole to release the breath" to the outside by means of the ring of adjusting the breath volume before a breath which is breathed into the mouthpiece arrives at the instrument to further restrict the breath volume arriving at the body of the ocarina by means of the section of restricting the wind way width of the inside of the mouthpiece. By doing this, it is possible to keep a standard performance to reduce a breath volume arriving at the body of the ocarina intentionally and thereby obtaining an effect of a mute finally.

It is characterized in that it is a two-tier system of an adapter (adapter) attached to between the mute equipment capable of controlling a breath pressure and the body of the ocarina. It is possible to attach to and detach from flexibly depending on a multiplicity including a shape of the blowing section of the wind instrument, a size around the blowing section and a size of the body of the instrument. In addition to this, the adapter has a function of the section of restricting the wind way width in inside of the mute equipment capable of controlling a breath pressure at the side of the adapter.

A raw material of the mute equipment capable of controlling a breath pressure is preferably a waterproof property in consideration of a saliva production. Any of a silicon rubber, plastic can be used as the raw material.

In addition to the mouthpiece, taking into account of a multiplicity of a shape of the blowing section of the wind instrument, a size of the blowing section and that of around the blowing section from a large size of the wind instrument (bass pipe to pronounce a bass range) to a small size of the wind instrument (soprano pipe to pronounce a bass range), as an equipment to play a role in a function of the interface between the wind instrument and mouthpiece, an addition of the adapter capable of attaching to and detaching from the wind instrument and the mouthpiece corresponding to two type of the wind instrument both for a large wind instrument and for a small wind instrument makes it possible to attach to all types of the wind instrument.

In this matter, it is possible to integrate one shape of the mouthpiece according to the present invention, the adopter makes it possible easily to be compatible with and attach to the blowing section of the wind instrument with a wide variety of a shape, since the raw material is a part being directly in touch with the blowing section of the wind instrument, it is possible to use a silicon rubber because it can not cause damage to the instrument to render a flexibility to be compatible with the wide variety as mentioned above.

Effect of Invention

The mute equipment capable of controlling a breath pressure according to the present invention has an advantage effect that it is possible for players to have the same feeling of blowing as they normally do by reducing breath volume reaching the body of the ocarina intentionally and thereby obtaining an effect of a mute finally. Furthermore, the mute equipment capable of controlling a breath pressure according to the present invention has an advantage effect that it is possible to have no impact on a tone interval and a tone quality by a shape of the inside of the wind instrument when turning the sound down, and it is possible to keep almost the same feeling of blowing as much as possible as at the time when the mute equipment according to the present invention is not attached.

Furthermore, the present invention has an advantage effect that it is possible for players to perform by selecting a breath volume to obtain preferable feeling of blowing, in addition to the effect of a mute, since the mute equipment can control a breath volume. Although the wind instrument such as the ocarina requires an unique breathing in accordance with the instrument without relation to a breath volume and a lung capacity of the player, the art according to the present invention makes it possible for the players to select the breath volume to some extent.

BRIEF DESCRIPTION OF THE DRAWINGS

FIG. 1 gives an example of an embodiment according to the present invention.

FIG. 2 gives an example of an embodiment according to the present invention, shows a diagram explaining a breath volume and a flow until a breath arrives at the body of the ocarina in a condition that a mouthpiece g and an adapter h are attached to the ocarina. Although g and h are separated in the embodiment according to the FIG. 2, these can be integrated.

FIG. 3 gives a diagram explaining an example in the case that it is observed from a back (a) and a front (b) in a condition that a mute equipment (mouthpiece) and an adapter are attached to the ocarina.

FIG. 4 gives an explanation diagram in the case that an usual ocarina is observed from a back (a) and a front (b).

FIG. 5 gives an explanation diagram showing an embodiment of the present invention that the first hole to adjust the breath volume 3, a ring of adjusting the breath volume 4 (both are shown as (a)), and a size of a hole to release a breath are controlled (b).

FIG. 6 gives an explanation diagram showing an embodiment of the present invention that (a) each section of restricting a wind way width of both a mouthpiece g and an adapter h (both are shown as (a)) is expanded, (b) a condition that these are observed from the front, (c) a condition that a hole to adjust the breath volume are changed, (d) a condition that a section of restricting a wind way width 6 of a mouthpiece is changed by the control (in an example of the present invention, it is in the case that the section of restricting a wind way width is restricted).

FIG. 7 gives an explanation diagram showing a condition of an embodiment of the present invention that a small size of an auxiliary adapter for the ocarina (a mini adapter).

Although it is for a small size in this figure, but it is possible to use a large size of adapter in the case of the large wind instrument.

FIG. 8 gives an embodiment of the present invention that the mute equipment capable of controlling a breath pressure is molded integrally with an adapter section. FIG. 8 (*a*) is a diagram in that case that it is observed from a direction of the blowing section. FIG. 8 (*b*) gives a cross-section diagram of B-B direction in the FIG. 8 (*a*). FIG. 8 (*c*) gives a diagrammatic perspective view of an embodiment of the present invention. FIG. 8 (*d*) gives a cross-section diagram of A-A direction in the FIG. 8 (*a*). FIG. 8 (*e*) is a diagram in the case that the mute equipment capable of controlling a breath pressure according to an embodiment of the present invention is observed from an upper side. FIG. 8 (*f*) gives an example of a member of a section of restricting a wind way width.

MODE FOR CARRYING OUT THE INVENTION

The mute equipment capable of controlling a breath pressure according to the present invention is characterized in that it is a mute equipment capable of controlling a breath pressure to be attached to the blowing section of the wind instruments, wherein the equipment has a hole to release the breath and a section of restricting a wind way width. As an instrument capable of applying to the equipment, mention may be made of an instrument with a structure wherein it has a blowing section and a wind way existing between the blowing section and a pronunciation section and thereby breathing into the blowing section to pronounce. Moreover, the mute equipment capable of controlling a breath pressure can be attached to the blowing section or be integrated to the blowing section preliminarily. For example, as an instrument capable of applying to the equipment, mention may be made of a wind instrument. A wind instrument is not particularly limited. For example, the present invention can preferably apply to an instrument such as a keyboard harmonica, an Indian flute, an ocarina, a tin whistle, a recorder. The mute equipment capable of controlling a breath pressure according to the present invention can be attached to the blowing section of the wind instruments, is also so called mouthpiece.

In the present invention, a hole to release the breath is not particularly limited as long as it is possible to release the breath passing through the wind way. In the present invention, a shape and a structure etc., of the hole to release the breath are not also particularly limited to.

In the present invention, a section of restricting a wind way width is also not particularly limited as long as it is possible to control a wind way width to control a flow of a breath passing through the wind way. A position of the section of restricting a wind way width is also not particularly limited. For example, the section of restricting a wind way width may be set to the blowing section of the mute equipment capable of controlling a breath pressure, or may be set to around the hole to release the breath (in this case, as mentioned below, these can be used as both the section of restricting the wind way width and the section of adjusting a breath volume each other. That is, one member makes it possible to control the wind way width to adjust the breath volume passing through the wind way and thereby being able to control an amount of breath to be released from the hole to release the breath to the outside of the wind way), or may be set to a side of the adapter section (a side of the body of the instrument).

In the case that the section of restricting a wind way width may be set to the blowing section, in consideration of a degree of a mute, a member having a desired size may be inserted to the blowing section. If an inserted member having a various sort of a size can be prepared, and can be replaceable, a general versatility will increase. A window or the like can be set to the blowing section, and the window can be opened and closed according to the degree of the desired mute to control a breath volume passing through the blowing section and thereby obtaining some level of an effect of a mute. In the present invention, once a member can be exchanged etc., as mentioned above, a desired effect of a mute can be obtained by just giving a performance in a normal manner.

Furthermore, in a preferred embodiment of the mute equipment capable of controlling a breath pressure according to the present invention, it is characterized in that the equipment further has a section of adjusting a breath volume to adjust the size of the hole to release the breath. The section of adjusting a breath volume is not limited, as long as it is possible to control the size of the hole to release the breath. For example, a replaceable section of adjusting a breath volume can be inserted to the inside of the wind way to design it so as to release a breath having desired breath volume flowing from the hole to release the breath. A preparation of a number of the section of adjusting a breath volume having a various sort of size makes it possible to insert a most suitable section of adjusting a breath volume to the inside of the wind way according to a desired condition and thereby controlling the breath volume to attain a desired mute. As the section of adjusting a breath volume, mention may be made of a member comprising a hollow tube, a fabric, a felt, a cotton and a gauze. In the case of the member comprising a hollow tube, the member comprising a hollow tube can be inserted into the inside of the wind way to adjust a size of the opening of the hole to release the breath. Further, a fabric, a felt, a cotton, a gauze or a member comprising one or more of these materials can also be inserted into the inside of the wind way to adjust a size of the opening of the hole to release the breath. As a material of the member comprising a hollow tube, for example, mention may be made of a silicon rubber, rubbers in general other than the silicon rubber, woods in general, plastics in general, glasses in general, and those of a material making it hard for air to pass through. Moreover, a tag can set to the member comprising a hollow tube so that it can remove easily. It is possible to catch the tag with a tweezer so as to make it easy to pull out the member comprising a hollow tube.

Furthermore, in a preferred embodiment of the mute equipment capable of controlling a breath pressure according to the present invention, it is characterized in that the section of adjusting a breath volume can be used as the section of restricting the wind way width. For example, in the case that the section of adjusting a breath volume is a hollow tube, while a size of the opening of the hole to release the breath can be adjusted at an outside portion of the hollow tube, a change of a size of a hole existing a hollow portion of an inside of the hollow tube, for example, a change of a diameter of a hole if the hollow tube is a circular form, makes it possible to adjust the breath volume by controlling the wind way width. If a size of a hole existing a hollow portion of the member comprising the hollow tube is large, more breath can flow, on the other hand, a size of a hole existing a hollow portion of the member comprising the hollow tube is small, less breath can flow in an inside of the wind way. By doing so, it is possible to attain a desired effect of a mute.

Furthermore, in a preferred embodiment of the mute equipment capable of controlling a breath pressure according to the present invention, it is characterized in that the section of adjusting a breath volume can adjust the breath volume by using a ring of adjusting the breath volume. In the case of the above hollow tube, replacing the section or the member makes it possible to control a size of the opening of the hole to release the breath, or to control the breath volume passing through the wind way. Although a ring of adjusting the breath volume is also replaceable, but it may be not necessary to replace. For example, two rings of adjusting the breath volume can be set at the outside and the inside and set the hole to release the breath to both the outside and the inside rings of adjusting the breath volume. The rotation of the outside or the inside ring of adjusting the breath volume makes it possible to change a size of the opening of the hole to release the breath without limitation.

Furthermore, in a preferred embodiment of the mute equipment capable of controlling a breath pressure according to the present invention, it is characterized in that the section of restricting the wind way width has the first hole to adjust the breath volume. Furthermore, in a preferred embodiment of the mute equipment capable of controlling a breath pressure according to the present invention, it is characterized in that the section of restricting the wind way width is replaceable. For example, as a hollow tube as mentioned above, the preparation of a hollow tube having a hole of a desired size (a hole to adjust the breath volume) makes it possible to attain a desired effect of a mute.

Furthermore, in a preferred embodiment of the mute equipment capable of controlling a breath pressure according to the present invention, it is characterized in that a shape of a cross section of the first hole to adjust the breath volume is a circular arc pattern or a semicircular shape. A shape of a cross section of the first hole to adjust the breath volume may be a circular arc pattern or a semicircular shape as well as a circle, a triangular shape, a quadrangle shape, a polygon or a various sort of a shape other than the abovementioned shape. These shapes also make it possible to slide and set a shape of a cross section from a center of a rotation axis. A shape of a cross section of the second hole to adjust the breath volume is an example of a preferable embodiment in the case that a size of the opening of the first hole to adjust the breath volume is adjusted by the rotation of the section of restricting the wind way width. A width, a size and a shape of the circular arc of the circular arc pattern are not particularly limited. It is possible to design it according to the desired effect of a mute.

Furthermore, in a preferred embodiment of the mute equipment capable of controlling a breath pressure according to the present invention, it is characterized in that the blowing section of the wind instruments is multiple, and the mute equipment capable of controlling a breath pressure can be applied to these multiple blowing sections. For example, in a specific wind instrument (a multiple wind instrument) with one or more blowing section(s) of the wind instrument such as the ocarina, in a similar way, this aims to connect the same number of the mute equipment capable of controlling a breath pressure (mouthpiece) as the blowing section of the body of the multiple pipe type of wind instrument with the blowing section of the body of the multiple pipe type of wind instrument so as to be compatible each other and thereby being able to obtain the same effect of a mute as a single pipe type of the wind instrument.

Furthermore, an adapter according to the present invention is characterized in that the adapter can be installed between the mute equipment capable of controlling a breath pressure according to the present invention and a body of the wind instrument, wherein the adapter is capable of attaching to and detaching from the mute equipment capable of controlling a breath pressure and the body of the wind instrument. Furthermore, in a preferred embodiment of the adapter according to the present invention, it is characterized in that the adapter further has a function of the section of restricting the wind way width at the side of the adapter. This means that it is also possible to set a section capable of controlling a breath volume of a breath passing through the wind way at an adapter side. Moreover, in this embodiment, although the mute equipment capable of controlling a breath pressure and the adapter can be attached to and detached from each other, it is also possible to integrate the mute equipment capable of controlling a breath pressure with the portion of the adapter. In this case, the mute equipment capable of controlling a breath pressure can have a portion of the adaptor capable of connecting with the body of the wind instrument.

Furthermore, in a preferred embodiment of the adapter according to the present invention, it is characterized in that the adapter further has the second hole to adjust the breath volume. The second hole to adjust the breath volume makes it possible to adjust the breath volume passing through the wind way in corporation with the first hole to adjust the breath volume as mentioned above. Furthermore, in a preferred embodiment of the adapter according to the present invention, it is characterized in that a shape of the cross section of the second hole to adjust the breath volume is a circular arc pattern or a semicircular shape. A shape of a cross section of the second hole to adjust the breath volume may be a circular arc pattern or a semicircular shape as well as a circle, a triangular shape, a quadrangle shape, a polygon or a various sort of a shape other than the above-mentioned shape. These shapes also make it possible to slide and set a shape of a cross section from a center of a rotation axis, and it is not particularly limited to a circular arc pattern or a semicircular shape. It is an example of a preferable embodiment in the case that a size of the opening of the second hole to adjust the breath volume is adjusted by the rotation of the section of restricting the wind way width. A width, a size and a shape of the circular arc of the circular arc pattern are not particularly limited. It is possible to design it according to the desired effect of a mute.

Furthermore, in a preferred embodiment of the adapter according to the present invention, it is characterized in that the adapter further has an auxiliary adapter. It is possible to apply the auxiliary adapter to both a wind instrument in variety of sizes and the mute equipment capable of controlling a breath pressure according to the present invention successfully. For example, it is possible to set and apply a mini adapter having a smaller diameter than that of the adapter to the inside of the portion of the adapter of the mute equipment capable of controlling a breath pressure according to the present invention to a small wind instrument, while it is possible to set and apply a adapter having a larger diameter than that of the adapter other than the auxiliary adapter to the outside of the portion of the adapter of the mute equipment capable of controlling a breath pressure according to the present invention to a large wind instrument.

Furthermore, a wind instrument according to the present invention is characterized by having the mute equipment capable of controlling a breath pressure according to the present invention and/or the adapter according to the present invention. That is, not only an outside part such as a mouthpiece, but a combination of preliminarily integrating a mechanism based on the present invention with the body of the instrument, makes it possible to obtain the same effect of a mute.

EXAMPLE

At this moment, the present invention will be concretely explained in more details with reference to Examples, but the interpretation of the claims of the invention shall not be limited to the examples of embodiment of the present invention included in Examples. Moreover, it is obvious that it is possible to accordingly change its embodiment without departing from the subject-matter of the present invention.

Example 1

At first, as an example of the wind instrument, an ocarina, which has been pointed out that it is difficult to apply a mute equipment for an air reed instrument of the prior art, as a wind instrument, the application of the mute equipment capable of controlling a breath pressure according to the present invention (mouthpiece) was examined. In consideration of a property caused by a practically "urceolate shape" of the ocarina, it was designed so that an effect of a mute could be obtained by controlling the breath volume from a viewpoint of a professional performer of the ocarina.

Although an ocarina comprises a wind way (a portion wherein a breath blown from a blowing section passes through—b of FIG. 3), an edge (a portion wherein a breath from an outlet of the wind way hits to divide the breath into an inside of the ocarina and an outside of the ocarina—c of FIG. 3), and a window section (a portion wherein a breath from an outlet of the wind way hits to release the breath to an outside of the ocarina—d of FIG. 3), the shape of ocarinas varies from manufacturer to manufacturer, being different from that of recorders, etc.

Furthermore, since a range capable of being pronounced by an ocarina is generally limited to be one and a half octaves, in order to solve the problems of a narrowness of these range, an ocarina having a various sort of a size according to a range such as soprano, alto, tenor and bass etc., and multiple pipe type wind instrument with wider ranges have been manufactured.

In consideration of these features, since it is difficult to attach a mute equipment for an air reed according to the prior art itself to the ocarina, it is necessary to make it possible to attach a mute equipment to the ocarina with no additional attachment to each portion such as the wind way of the ocarina, the window portion and the edge portion existing at a backside of the ocarina, and further with no influences on a tone hole (FIG. 4-*f*) existing at a front side and a backside.

Moreover, it requires not to disturb fingerings during the performance even when a mute equipment is attached to the ocarina.

Although an ocarina made by plastics is also commercially available, but since a mainstream of an ocarina is absolutely made by "a ceramic work", and therefore, it is extremely easy to be broken.

In particular, the wind way, the window section, and the edge are most important portion to pronounce, and if these portions are broken, in the worst case, it is impossible to pronounce.

Therefore, it is needed to be capable of attaching to and detaching from without causing damage to these portions.

Although an ocarina is classified into the same class as the wind instrument (the air reed instrument) such as a recorder or a flute, comparing with a recorder or a flute, the ocarina is extremely different from them in an outer shape and a shape of a resonant system.

The explanation concerning a specific point of difference in the outer shape and the shape of the resonant system is as follows. In the case of the recorder or the flute, it is an open-end tube which both ends of the body are opened (a circular cylinder tube), a column of an air (air column or air core) existing in inside of the tube of a tubular body makes it possible to resonate (sympathetic vibration) to make a sound.

On the other hand, in the case of an ocarina, it is a closed end tube (a conical tube) which one end of the body is opened and the other end of the body is closed, moreover, it has a characteristic that an inside diameter of the one end is small and the inside become gradually larger toward the other end to resonate an air inside of the tube to make a sound.

Furthermore, if it is taken into consideration in details, an ocarina is substantively urceolate and has a left-right asymmetry. Therefore, the ocarina should not be defined as "tube".

Since it is urceolate, comparing with a recorder etc., a sound quality of the ocarina is close to that of a sine curve which has less harmonic overtone.

Even if the same fingering is applied (that means that the same musical interval is made no matter who is playing the ocarina), when the player tries to control the breath to blow into the ocarina, a sound volume and the musical interval become unstable in tandem, either lower or higher comparing to its proper level. At the same time, the quality of the sound will deteriorate accordingly.

To "deteriorate" means that a sound to be created deviates from the sound specific to ocarina or the sound close to a sine curve.

Moreover, a sound production is changed from a bass register to treble part.

For example, when a player of the ocarina is going to produce a sound of "C" and shift to "D", "E" and "F" in this order, the player is required to blow in to the ocarina gradually stronger when shifting from a bass register to treble part in order to produce these sounds at correct musical interval.

Therefore, unlike in the case of the other wind instrument having an air reed, it is basically impossible to control the sound volume (rendering a dynamics expression) on ocarina due to the characteristics mentioned above.

Although it is needed to blow in gradually stronger when shifting from a bass register to treble part under normal circumstances as mentioned above, this means that if the mute equipment for an air reed instrument of the prior art is applied to the ocarina, the player must brow in to the ocarina gradually weaker instead.

Therefore, in the case that a player with a beginner or an intermediate grade of a performing technique attaches the mute equipment for an air reed instrument of the prior art to the ocarina, a control of the breath becomes difficult, in addition to a very high possibility that it is impossible to produce a sound properly, and there are also possibilities that a player falls into an undesirable habit in a manner of controlling the breath (to produce sounds at proper musical interval).

Further, since the ocarina is a monophonic instrument, in many cases, the player of the ocarina needs other player(s) of other musical instrument. In a present state, there are a lot of chances that the player practices the ocarina to the musical accompaniment.

In a circumstance that a big noise must be restricted, there are also situations that the player should play the ocarina with lower volume to the musical accompaniment.

In the case of the ocarina, a good and bad of the conditions of a voicing section, in particular an edge section makes it possible to have a great impact on a sound quality.

According to a common knowledge concerning the ocarina, when touching these sections, a very careful handling is required even if a professional ocarina player does this.

Still more, when a general amateur player touches these sections, it is easily expected that a damage will occur.

Therefore, if it is possible, making every effort to avoid touching these sections is highly recommended as appropriate handling of ocarinas.

As summarized the points so far, since the ocarina is urceolate-shaped instrument, if the mute equipment for an air reed instrument of the prior art is applied to these sections of the ocarina, the player must blow in weaker so that musical interval (pitch) may go down. Further, the ocarina has a variety in shape, etc., the mute equipment must be rich in diversity in shape by maker, and also a fine adjustment must be made for each equipment when it is attached to the ocarina.

In some cases, the ocarina does not make sound at all due to improper manner of attaching the mute equipment, and even this important section may be damaged.

Therefore, if the mute equipment for an air reed instrument of the prior art is applied to the ocarina, at this time, it is impossible to attain a desired effect of a mute sufficiently as well as the player will eventually bear a heavy burden.

Because of this situation, the inventor according to the present invention tried to develop a mute equipment capable of controlling a breath pressure having a general versatility according to the present invention by using the ocarina which is a unique wind instrument as a starter.

An example of an embodiment according to the present invention will be shown in FIG. 2. This shows a condition of the inside in the case that a mouthpiece g and an adapter h are attached to a body of ocarina. The use of the silicon rubber as a material for a mouthpiece g and an adapter h makes it possible to attach and seal hermetically without damaging a mouthpiece g and a contact section of the body of ocarina 7.

FIG. 3 gives a diagram explaining an example in the case that it is observed from a back (a) and a front (b) in a condition that a mouthpiece g and an adapter h according to the present invention are attached to the body of ocarina.

In FIG. 2, an amount and a flow of the breath 8 blown from the blowing section 1 of the mouthpiece are shown by the number of arrows and a direction of each arrow.

Regarding a hole to release a breath 3, since an undesired sound (so-called sibilant) occurs by contacting the breath to a wall of the wind way or a various sort of barriers during flowing an air, the opening of the hole to release a breath 3 with a slope makes it possible to reduce this undesired sound.

The player contacts his mouth to the blowing section 1 of the mouthpiece attached to the ocarina to blow the breath.

At first, a blown breath 8 passes through the wind way 2 of the inside of the mouthpiece.

After that, a part of the breath 8 comes near to a hole to release a breath 3 to release from a hole to release a breath 3 to the outside of the mouthpiece.

At this time, a volume of the breath to be released to the outside is set by rotating a ring of adjusting the breath volume 4 by adjusting a size of the hole to release a breath 3 (a method of adjusting is shown in FIG. 5.).

By doing so, a breath volume arriving at the body of the ocarina is reduced, as well as a resistance caused by blowing the breath is softened.

In this manner, a part 9 of the breath from a hole to release a breath 3 is discharged and the other breath which is not discharged arrives at a section of restricting a wind way width 6 within a mouthpiece (a part of a section of restricting a wind way width).

Since at this point the width becomes much narrower, the breath stays in and its speed is reduced (10).

The control of a section of adjusting a wind way width 5 within a mouthpiece (that is, a section of contacting each part of both the mouthpiece g and the adapter h) makes it possible to further restrict the volume of the breath (a method of controlling is shown in FIG. 6.). In this way, a two-step adjustment of the breath volume by means of a hole to release a breath 3 and a section of restricting a wind way width 6 makes it possible to restrict an initial breath 8 blown from the blowing section 1 of the mouthpiece considerably passing through a section of restricting a wind way width 6 within a mouthpiece to arrive at the body of the ocarina.

11 shows that the breath volume is considerably reduced.

Therefore, even if the player blows in as per normal, the breath volume is extremely restricted, and thereby only small volume of the breath will be delivered to the body of the ocarina without precisely controlling the breath.

A condition of adjusting a size of a hole to adjust the breath volume 3 is shown in FIG. 5.

As shown in (a), by rotating a ring of adjusting the breath volume 4 in the direction indicated by the arrow as shown in (b) to reduce the size of the hole to adjust the breath volume 3 (3*a*), the breath volume to be discharged to outside of the ocarina from the hole to adjust the breath volume 3 will be reduced. By further rotating the ring of adjusting the breath volume 4 in the same direction, the hole to adjust the breath volume 3 will be completely closed (3*b*).

By doing so, it is possible to adjust a volume of a breath to be discharged without limitation.

A method of adjusting a wind way width and a principle thereof are shown in FIG. 6. A hole to adjust 12 and a hole to adjust 13 having the same size and shape each other are opened in each section of restricting a wind way width 6 of both a mouthpiece side g and an adapter side h (collectively referred to as "a"). If a mouthpiece g is combined with an adapter h, a face of the hole to adjust 12 is contacted firmly to that of the hole to adjust 13.

The hole to adjust 12 and the hole to adjust 13 which are overlapping each other, are positioned in a place which is sifted from a center of a circle.

Enlarging and looking at a section of restricting a wind way width 6 in a mouthpiece existing in a mouthpiece side g from straight ahead of the front side, FIG. 6 (*b*) shows that a hole to adjust is fully opened. In other words, this means that a shape and a position of a hole to adjust 12 and a hole to adjust 13 are overlapping exactly each other.

Looking at a section of controlling a wind way width 5*a* of a mouthpiece side g and a section of controlling a wind way width 5*b* existing in an adapter side h from the side, FIG. 6 (*c*) shows that they are contacted and overlapped each other, and shows a rotation in a direction of an arrow 14 of a section of controlling a wind way width 5*a* within a mouthpiece of a mouthpiece side g.

By doing so, even after sliding the positions of both the hole to adjust 12 and the hole to adjust 13 which are overlapping exactly each other, only a portion of overlapping remains open.

Hereby, it is possible to control a width of a section of restricting the wind way width 6 without limitation.

An application of a grease etc., to a portion of contacting a mouthpiece g and an adapter h makes it possible to rotate smoothly.

A mini adapter in order to correspond with a size of the ocarina is shown in FIG. 7.

In consideration of the variety of the ocarina, in order to be able to attach hermetically even if it is a small size of the ocarina (soprano), attaching a mini adapter made by the same silicon rubber inside of a section of contacting a mouthpiece with a body of the ocarina 7 made it possible to attach the mute equipment to all size of ocarina from small to large.

In this way, it is possible to have many variations of the present invention in consideration of the other materials having the same property and of the size of ocarina, and the all of these changes in materials and variations in size will be included in a scope of the present invention, and therefore the present invention is not intended to be interpreted as being limited to Example 1.

As mentioned above, the ocarina has a property of "urceolate shape", and originally has a property capable of producing a sound with a minimum sound volume "keeping a musical interval or a sound quality". It has been confirmed that the performance taking advantage of these property is a "Milt system mute performance" designed by the present inventor.

However, in order to play with this performance method, an extremely fine use of a breath is required (a control of a volume or a strong and weak of a breath). Therefore, even if it is a professional player, the number of professional players who can attain this technique is significantly limited, and in fact, it has been thought that the ocarina originally does not have such a mute function.

Far from it, since it is extremely difficult to attain this technique, not so many people know the existence of this mute function in the present ocarina industry, and therefore it has been thought that it is impossible to realize such a mute function for ocarinas.

However, this time, it has been revealed that the present invention makes it possible to render a function of mute easily by anybody even if it is a unique wind instrument such as an ocarina. That is, the use of the mouthpiece according to the present invention without the use of an extremely fine breath, makes it possible to flexibly control the volume of breath to be entered into the instrument. That is, it have been revealed that it is possible to attain the same feeling of blowing in as in the case of no attachment of a mouthpiece without no impact on a musical interval and a sound quality to be able to produce a sound by a very small sound volume (which is less than about 25 decibels by a brief measure, that is, it means that a 1/10 or more of the sound volume comparing with the original volume will be reduced.), and thereby it being possible to play the ocarina.

Furthermore, a various sort of the effect is also revealed and the first complemental effect will be explained as follows. Even if there are some problems that a musical interval is improperly reduced, a damage to the instrument, and inevitably becoming an economic burden for a performer, in the case of the application of a mute equipment for an air reed of the prior art, the use of a mouthpiece and a two-step type of adapter according to the present invention makes it possible to design a setting of a section of adjusting mouthpiece to realize a performance with almost the same standard performance in a normal manner.

The second complemental effect will be mentioned as follows. The ocarina has a variation of quality according to a manufacture or an individual and has a wide variety such as from those of requiring a strong breath to those of requiring a fine weak breath.

Even if a "10" degree of a strength of breath for a certain performer is proper according to a physical ability of the performer, depending on the instrument, because of a physical structural reason (a narrow blowing section or a narrow embouchure hole, a small size of ocarina in itself etc.), there are some instruments that a "7" degree of a strength of breath should only be required.

These numeric value is given for convenience sake in order to explain the degree of the breath to be blown.

In such case, in general, although a performer should make a performance with a weak breath so as to achieve a "7" degree of a strength by himself depending on the instrument, on this occasion, because of an influences of a carbon dioxide which is remaining in a lung because the air in the lung is not brown out enough, the performer may became oxygen-deprived.

Further, because of a poor adjusting, the performer breathes into the instrument too much, and thereby resulting in a stress for ears due to the sound of ocarina and resulting in a mega volume which makes an audience feel uncomfortable etc., when listening. And therefore, there are possibility that it is impossible to perform with a proper tone quality and musical interval.

Even if the user is faced with such a problem, the attachment of the mouthpiece according to the present invention makes it possible to produce a proper breath volume into the ocarina with the same feeling of blowing as usual.

At last, a promising effect for the entire ocarina industry will be explained.

These effect according to the present invention makes it possible for people not to worry about circumstances such as the night time or a neighborliness, and thereby increasing a time for practice of the ocarina substantively.

It is thought that this makes it possible to increase the level of performance, and make a contribution to an improvement of motivation of the general amateur ocarina players who would like to perform on the stage with their achievement of practice. As a result, more people will want to participate in an ocarina festival or an ocarina-related event that is developing and increasing in many parts of the nation.

Next, because there is an image of "healing" of ocarina being firmly taking root in Japan and it is possible to start casually without substantial resources, about eight out of ten of the amateurs of ocarina in Japan are aged females (mainly married woman).

Therefore, ocarina manufactures, event organizers relating to ocarina, retail stores of instrument, managers of ocarina school, sellers of books, method books and goods relating to ocarina think that an ocarina market of Japan has already matured, and they have worried about a saturation in or a depletion of a future market under the current continued situation.

On the other hand, in countries where an ocarina becomes popular, such as South Korea, Taiwan other than Japan, there is an opportunity to be exposed to an ocarina from early childhood, it is adopted in the education institutions there as a regular music instrument.

Therefore, it is thought that it should be a bustling market which a stable demand of ocarina is also continuously expected in a future.

Example 2

Next, a mute equipment capable of controlling a breath pressure of the present invention in the other preferred embodiment was examined. FIG. 8 gives an embodiment of the present invention that the mute equipment capable of controlling a breath pressure is molded integrally with an adapter section. FIG. 8 (*a*) is a diagram in that case that it is observed from a direction of the blowing section. FIG. 8 (*b*) gives a cross-section diagram of B-B direction in the FIG. 8 (*a*). FIG. 8 (*c*) gives a diagrammatic perspective view of an embodiment of the present invention. FIG. 8 (*d*) gives a cross-section diagram of A-A direction in the FIG. 8 (*a*). FIG. 8 (*e*) is a diagram in the case that the mute equipment capable of controlling a breath pressure according to an embodiment of the present invention is observed from an upper side. FIG. 8 (*f*) gives an example of a member of a section of restricting a wind way width. In FIG. 8, 20 is a blowing section, 21 is a hole to release a breath, 22 is a wind way, 23 is an adapter section, 24 is a member of controlling a wind way width, 25 is an example of the installation of the member of controlling a wind way width, 26 is a blowing section, 27 is an inside diameter of the member of controlling a wind way width, respectively.

The breath entering into the blowing section 20 passes through the wind way 22 into a hole to release a breath 21. At this time, a member 24 comprising a hollow tube is designed as shown in FIG. 8 (*f*) to insert it from a direction of an arrow 25. For example, a multiple member comprising a hollow tube 24 which has a different length, are prepared. And, a long member 24 makes it possible to seal an opening portion of a hole releasing a breath 21 substantially to reduce a breath volume discharged from a hole to release a breath 21. On the other hand, if a short member 24 is prepared, it is possible to increase a breath volume discharged from a hole to release a breath 21. By doing so, it is possible to control a breath volume to be released from a hole to release a breath 21. In this case, although a section of adjusting a breath volume can be constituted by a member comprising a hollow tube 24, it is not limited to this.

Moreover, it is possible to adjust the volume by changing an insert condition of the section of adjusting a breath volume etc., with no change of the length thereof. It is also possible to prepare a multiple section having a different size with the same diameter.

That is, an outer part of the member comprising a hollow tube 24 makes it possible to contact with an opening of an inner part (a wind way part) of the hole to release a breath 21 to adjust a breath volume.

In a place being different from an opening part of the hole to release a breath 21, a hollow tube can play a role in a member of restricting a wind way width. In FIG. 8 (*f*), although it is a cylindrical shape, a hollow tube can be manufactured by being compatible with an opening of the blowing section 20, it is preferable in that case that the breath volume is adjusted at the blowing section. In this case, as shown in FIG. 8 (C), if the blowing section 26 can be replaceable, it is possible to prepare a various sort of the blowing section from those of having a small inside diameter 27 of the hollow tube to those of having a large one. If a large breath volume is required, a large inside diameter 27 of the hollow tube can be inserted. On the other hand, if a small breath volume is required, those with a small inside diameter 27 can be inserted. As a result, a desired effect of a mute can be attained.

If a desired length of the hollow tube is set, one hollow tube makes it possible to play a role in both a section of adjusting a breath volume and a section of restricting a wind way width. That is, an outside of the hollow tube makes it possible to adjust a condition of opening and closing of a hole to release a breath 21, as well as a controlling of a desired size of an inside diameter of the hollow tube makes it possible to control the wind way width. The present invention also contains such embodiments.

Moreover, this example is an embodiment that an adapter is integrally molded to the mute equipment capable of controlling a breath pressure. In this example, installing an auxiliary adapter inside of the adapter section makes it possible to apply it to a smaller wind instrument, as well as an installation of an auxiliary adapter at an outside of the adapter section makes it possible to apply it to a larger wind instrument.

Although it is not shown in Figure, installing a tag (a projecting portion) to a member of controlling a wind way width 24 makes it possible to be replaceable easily because it is possible to anchor the tag with tweezers.

Moreover, since the wind way exists in between the blowing section 20 and the adapter section 23, one or more sections of controlling a wind way width can be set in this interval. For example, it is possible to set it around the blowing section 20 and the hole to release a breath 21. It is also possible to set one or more sections of controlling a wind way width to a part or all of the wind way.

Moreover, although a member comprising a hollow tube is used as an example of the section of adjusting a breath volume, it is not limited to this. It was revealed that a control of a length of a member comprising a hollow tube makes it possible to control a size of a hole to release a breath to discharge a part of a breath coming near to a hole to release a breath from the blowing section of the mouthpiece to an outside of the mouthpiece from the hole to release a breath, and thereby reducing a sense of resistance produced by breathing into the blowing section.

Regarding a breath which cannot be discharged in this stage, the volume of a flowing breath can be controlled by a section of restricting a wind way width existing in an inside of a mouthpiece. As an example of a section of restricting a wind way width, a member comprising a hollow tube could be used. It was revealed that a control of a size of a hole of a hollow portion concerning the member comprising a hollow tube makes it possible to control the volume of a flowing breath in the wind way width and thereby attaining an effect of a desired mute. A two-step control of a breath volume made it possible to further reduce a breath volume and thereby considerably reducing a breath volume to be arrived at a body of the wind instrument through a section of restricting a wind way width existing in an inside of a mouthpiece.

By doing so, it was revealed that it is possible to keep a same feeling of blowing when an effect of a mute is attained.

Example 3

Next, a recorder was used as a wind instrument to examine how effective the mute equipment capable of controlling a breath pressure according to the present invention would be. Since it was possible to attain an effect of a mute in the case of the ocarina which has a most strict condition, an effect on the other wind instrument was examined.

As a result, if a part of the adapter was controlled, it was possible to attach it to a recorder with no problem to keep a same feeling of blowing and a breath pressure to reduce a breath volume arriving at the instrument. As a result, it was revealed that although a musical interval was slightly reduced, it was possible to attain an effect of a mute.

Since a mute equipment capable of controlling a breath pressure according to the present invention is flexible enough to attach to and detach from easily regardless a characteristic or a structure produced by a shape of a various sort of the wind instrument, in order to use the mute equipment capable of controlling a breath pressure according to the present invention, it is also not needed to buy another instrument. It is possible to apply the present invention to an instrument which a user already has, without placing an economic burden to the user.

Since a flexible material such as a silicon rubber can be used for a portion of directly contacting with an instrument, a physical burden for an instrument become less.

The use of such material makes it possible to attain a production and a manufacturing easily and inexpensively to render a color variation or a designability. It is also easy to remove the saliva and to do maintenance such as a cleaning.

Moreover, since the essence of the function of this mouthpiece is that "a breath pressure of the performer can be controlled", a various sort of a complemental effect other than the effect of a mute can be promised.

INDUSTRIAL APPLICABILITY

It is a common knowledge among parties concerned of the industry that an industry-wide activation and expansion is necessary to diffuse a wind instrument such as the ocarina to a young people in Japan.

In a view of these conditions of Japan, as well as case examples or expected demand in Korea or Taiwan etc., in which the wind instrument such as ocarina is popular, the present invention makes it possible to increase a chance to experience the wind instrument and improve their performance technique by the increase of an exercise time or a chance to improve an motivation of general amateurs and thereby increase a chance for them to participate in ocarina events, leading to the expectation that the attractiveness of the wind instrument itself will be more exposed.

Furthermore, this could draw attention from the younger generations to the existence of the wind instrument or the joy of playing them.

The present invention, as a whole, makes it possible to contribute to an industry-wide activation and expansion of the instrument which is an outstanding issue, and offer possibilities for ocarinas to be used the educational institutions together with a recorder as an instrument which can be easily played.

DESCRIPTION OF THE REFERENCE NUMERALS a a blowing section
b a wind way
c an edge section
d a window section
e an embouchure hole
f a tone hole (an opening of finger)
g a mouthpiece according to the present invention (it can omit as "a mouthpiece)
h an adapter according to the present invention (it can omit as "an adapter")
1 a blowing section of the mouthpiece
2 a wind way width existing in an inside of a mouthpiece
3 a hole to release a breath
3*a* a condition that a size of a hole to release turns down by rotating a ring of adjusting the breath volume 4 in a direction shown in an arrow
3*b* a condition that a hole to release is closed perfectly by rotating a ring of adjusting the breath volume 4 in a direction shown in an arrow
4 a ring of adjusting the breath volume
5 a section of controlling a wind way width existing in an inside of a mouthpiece (Since all of a mouthpiece g moves practically, it means that 5 comprise a part of the mouthpiece g)
5*a* a condition that the section of controlling a wind way width existing in an inside of a mouthpiece are observed from the front
5*b* a condition that the section of controlling a wind way width existing in an inside of a mouthpiece are expanded
6 a section of restricting a wind way width
7 a section of contacting a mouthpiece with a body of the ocarina
8 a volume of a breath blown from a blowing section of ocarina
9 a breath discharged from a hole to release a breath to an outside of the mouthpiece
10 a breath wherein a flow is restricted at the section of controlling a wind way width existing in an inside of a mouthpiece
11 a breath arriving at a body of ocarina
12 a hole to adjust (a mouthpiece side of the section of restricting a wind way width)
13 a hole to adjust (two steps type of an adapter side of the section of restricting a wind way width)
14 a direction for rotating a mouthpiece side of the section of restricting a wind way width
15 a mini adapter in inside of two steps type of an adapter (for a small ocarina)
16 a small ocarina (such as a soprano pipe)
20 a blowing section
21 a hole to release a breath
22 a wind way
23 an adapter section
24 a member of controlling a wind way width
25 an example of the installation of the member of controlling a wind way width
26 a blowing section
27 an inside diameter of the member of controlling a wind way width

The invention claimed is:

1. A mute equipment capable of controlling a breath pressure to be attached to the blowing section of the wind instruments, wherein the equipment has a hole to release a breath and a section of restricting a wind way width.

2. A mute equipment capable of controlling a breath pressure according to claim 1, wherein the equipment further has a section of adjusting a breath volume to adjust the size of the hole to release the breath.

3. A mute equipment capable of controlling a breath pressure according to claim 2, wherein the section of adjusting a breath volume can use as the section of restricting the wind way width.

4. A mute equipment capable of controlling a breath pressure according to claim 1, wherein the section of adjusting a breath volume can adjust the breath volume by using a ring of adjusting the breath volume.

5. A mute equipment capable of controlling a breath pressure according to claim 1, wherein the section of restricting the wind way width has the first hole to adjust the breath volume.

6. A mute equipment capable of controlling a breath pressure according to claim 1, wherein the section of restricting the wind way width is replaceable.

7. A mute equipment capable of controlling a breath pressure according to claim 5, wherein a shape of a cross section of the first hole to adjust the breath volume is a circular arc pattern or a semicircular shape.

8. A mute equipment capable of controlling a breath pressure according to claim 1, wherein the blowing section of the wind instruments is multiple, and the mute equipment capable of controlling a breath pressure can be applied to these multiple blowing sections.

9. An adapter installed between the mute equipment capable of controlling a breath pressure according to claim 1 and a body of the wind instrument, wherein the adapter is capable of attaching to and detaching from the mute equipment capable of controlling a breath pressure and the body of the wind instrument.

10. An adapter according to claim 9, wherein the adapter further has a function of the section of restricting the wind way width at the side of the adapter.

11. An adapter according to claim 10, wherein the adapter further has the second hole to adjust the breath volume.

12. An adapter according to claim 11, wherein a shape of the cross section of the second hole to adjust the breath volume is a circular arc pattern or a semicircular shape.

13. An adapter according to claim 9, wherein the adapter further has an auxiliary adapter.

14. A wind instrument characterized by having the mute equipment capable of controlling a breath pressure according to claim 1.

15. A wind instrument characterized by having the adapter according to claim 9.

* * * * *